US006799612B2

(12) United States Patent
Stewart et al.

(10) Patent No.: US 6,799,612 B2
(45) Date of Patent: Oct. 5, 2004

(54) FILLING APPARATUS

(75) Inventors: Paul Stewart, Youngstown, NY (US); Paul Hendrickx, Baarle-Nassau (NL); Frans Damen, Langeweg (NL)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 10/179,675

(22) Filed: Jun. 25, 2002

(65) Prior Publication Data

US 2003/0034086 A1 Feb. 20, 2003

Related U.S. Application Data

(60) Provisional application No. 60/311,823, filed on Aug. 14, 2001.

(51) Int. Cl.[7] ..... B65B 43/42

(52) U.S. Cl. ..... 141/181; 141/85; 141/89; 141/263

(58) Field of Search ..... 141/181, 89, 85, 141/97, 129, 153, 263; 422/100, 101, 102; 73/863.32, 863.1

(56) References Cited

U.S. PATENT DOCUMENTS

| | | | | | |
|---|---|---|---|---|---|
| 3,788,370 | A | * | 1/1974 | Hare et al. | 141/264 |
| 4,142,561 | A | * | 3/1979 | Bennett et al. | 141/181 |
| 4,401,141 | A | * | 8/1983 | Rosen et al. | 141/192 |
| 4,508,148 | A | * | 4/1985 | Trechsel et al. | 141/95 |
| 4,570,822 | A | * | 2/1986 | Procacino | 141/192 |
| 4,889,350 | A | | 12/1989 | Tranter | |
| 5,551,493 | A | * | 9/1996 | Sonntag et al. | 141/263 |
| 5,673,535 | A | | 10/1997 | Jagger | |
| 5,797,436 | A | * | 8/1998 | Phallen et al. | 141/129 |
| 5,819,816 | A | * | 10/1998 | Mayer | 141/153 |
| 5,848,515 | A | | 12/1998 | Catelli et al. | |
| 6,026,867 | A | * | 2/2000 | Klarl | 141/91 |
| 6,041,834 | A | * | 3/2000 | Fujikawa et al. | 141/90 |
| 6,105,634 | A | * | 8/2000 | Liebram et al. | 141/89 |

FOREIGN PATENT DOCUMENTS

| | | |
|---|---|---|
| EP | 0430897 A1 | 6/1991 |
| EP | 1090843 A2 | 4/2001 |
| NL | 7806249 | 7/1979 |
| WO | WO 00/63076 | 10/2000 |

* cited by examiner

*Primary Examiner*—Gregory L. Huson
*Assistant Examiner*—Khoa D. Huynh
(74) *Attorney, Agent, or Firm*—Ira Lee Zebrak

(57) ABSTRACT

A filling apparatus may include a conveyor for transporting the vials in an aseptic zone and a vial filler including a dispenser, for example, a filling needle, connected to a fluid supply. The vial filler may be disposed in the aseptic zone. The apparatus may also comprise a drive disposed in a non-aseptic zone, operatively connected to the vial filler, and configured to move the dispenser into and out of filling engagement with the vials being transported. The vial filler may further include a valve, for example, a pinch valve, disposed in the aseptic zone proximate the dispenser and movable with the dispenser for controlling the fluid flow through the dispenser.

30 Claims, 2 Drawing Sheets

FILLING APPARATUS

This application claims priority from U.S. Provisional Patent Application No. 60/311,823 filed Aug. 14, 2001.

TECHNICAL FIELD

The invention relates generally to a filling apparatus and, more particularly, to a filling apparatus configured to fill containers, for example, vials, with liquid products, for example, pharmaceuticals and the like.

BACKGROUND

Conventional fillers may include a filling system, for example, a time and pressure filling system. In a time and pressure system, a liquid product may be fed from a manifold through a plurality of flexible supply lines to a corresponding plurality of dispensers, for example, filling needles, nozzles, or the like. A valve may be associated with each flexible supply line.

The quantity of liquid dispensed may be controlled by the valves. In order to dispense a desired quantity, the valves may be opened for a certain period of time dependent upon, among other things, the pressure and temperature of the liquid product. The valves may be configured as pinch valves that pinch the flexible supply line to stop the flow of liquid and lessen the pinch to start the flow. When the valves open, the liquid product may be dispensed from the dispensers into a corresponding plurality of vials.

The dispensers may be associated with a structure that follows the motion of the vials as they progress along a conveyor system through the filling system. In the case of needle-type filling dispensers, the structure may be referred to as a needle bridge. Because the liquid supply lines are flexible, the dispensers may move while the product supply manifold remains stationary. Since the valves in conventional fillers are also stationary, the dispensers may move relative to their corresponding valves. This relative motion may cause the flexible supply lines to change shape, which in turn causes a change in internal volume. As a result, the accuracy of the filling system may be compromised.

In addition, the measurement of temperature and pressure of the liquid product is conventionally performed in the product supply manifold. The measurement of temperature remote from the dispensers can introduce filling errors if the fluid flow properties are temperature sensitive.

SUMMARY OF THE INVENTION

According to one optional aspect of the invention, an apparatus may be provided for aseptically filling vials with fluid. The apparatus may comprise a conveyor for transporting the vials in a clean and sterile zone, such as an aseptic zone, and a vial filler including a dispenser, for example, a filling needle, connected to a fluid supply. The vial filler may be disposed in the aseptic zone. The apparatus may also comprise a drive disposed in a non-sterile or non-aseptic zone, operatively connected to the vial filler, and configured to move the dispenser into and out of filling engagement with the vials being transported. The vial filler may further include a valve, for example, a pinch valve, disposed in the aseptic zone proximate the dispenser and movable with the dispenser for controlling the fluid flow through the dispenser.

According to another optional aspect of the invention, the apparatus may include a fluid temperature sensor disposed in the aseptic zone proximate the dispenser and movable with the dispenser. The dispenser may be fluidly connected to the fluid supply by a conduit, at least a portion of which is elastically deformable. The valve may be configured as a pinch valve positioned to engage the elastically deformable portion.

According to yet another optional aspect of the invention, the dispenser may be fluidly connected to the fluid supply by a conduit having an interior passage. The valve may be operatively connected to the conduit. The cross-sectional shape of a portion of the conduit disposed between the valve and the dispenser may remain substantially unchanged during movement of the dispenser. The apparatus may further include a valve actuator movable with the vial filler.

According to still another optional aspect of the invention, the apparatus may further comprise a substantially horizontal table. A slight tilt to the table can be provided to assist in drainage and collection during cleaning or spillage. The space below the table may comprise the non-aseptic zone. The apparatus may also include an enclosure positioned above the table and configured to cooperate with the table to define the aseptic zone.

According to another optional aspect of the invention, the measurement of parameters that affect the filling accuracy, for example, temperature, may be carried out as close as possible to the point at which filling is taking place, that is, the dispensers. Additionally or alternatively, the valves that control the fill amounts may be positioned as close as possible to the point at which filling is taking place, that is, the dispensers. Additionally or alternatively, the valves may be positioned such that there is no relative motion between the valves and the dispensers during the filling process. As a result, the apparatus may provide more accurate filling.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION

Reference will now be made in detail to embodiments of the invention, examples of which are illustrated in the accompanying drawings. In accordance with the present invention, a filling apparatus is provided. The filling apparatus may be used, for example, to fill containers, for example, vials, with fluid.

Figure 1:
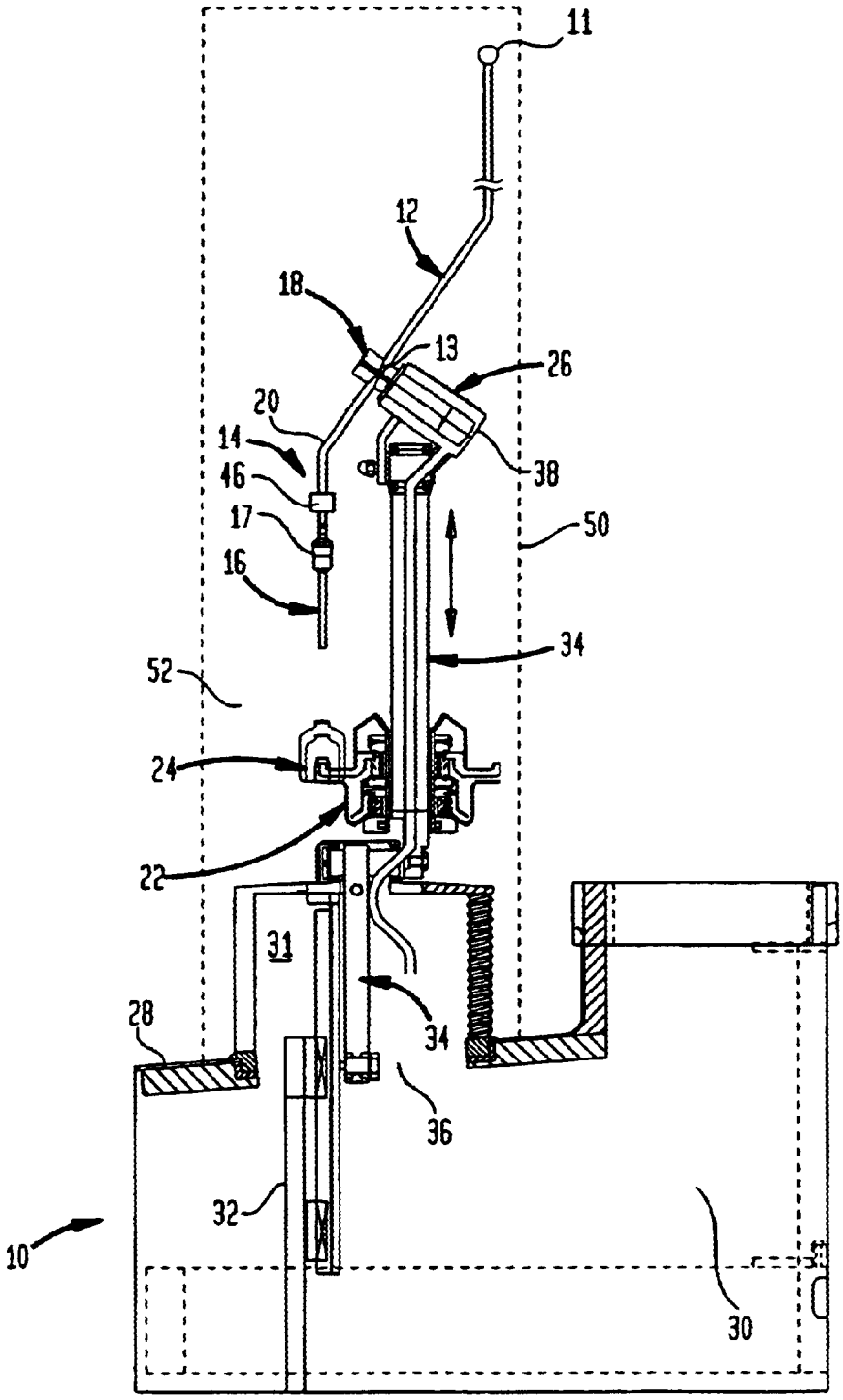
FIG. 1 is a cross-sectional view of a filling apparatus in accordance with an embodiment of the present invention.
Figure 2:
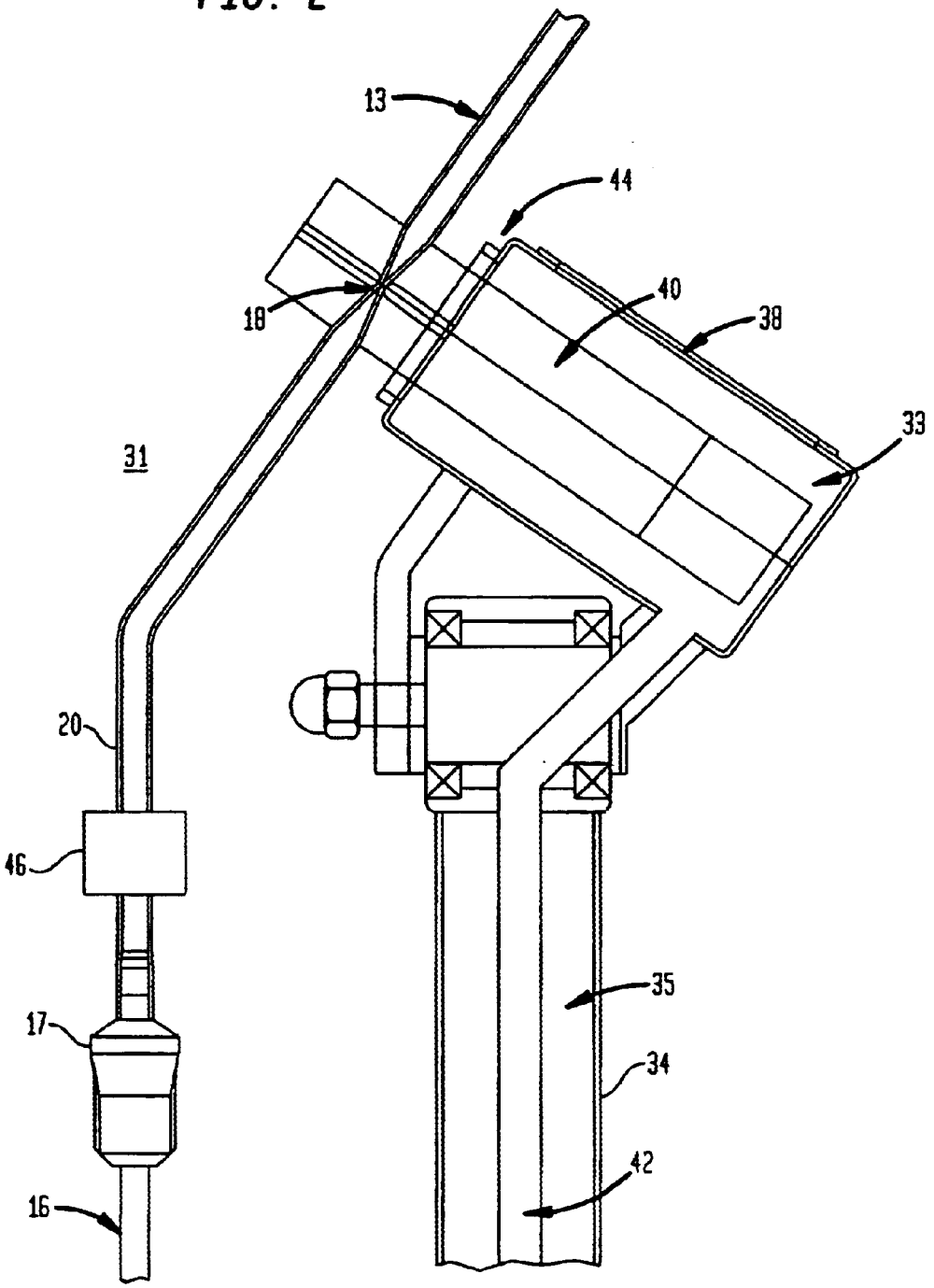
FIG. 2 is a cross-sectional view of a portion of the filling apparatus shown in FIG. 1.

Referring to FIGS. 1 and 2, a filling apparatus 10, which may be an in-line filling machine, may include a product supply manifold 11, at least one supply line 12, and a filler configured to fill containers, for example, a vial filler 14. Each supply line 12 may be disposed between the product supply manifold 11 and the vial filler 14. Each supply line 12 may be configured as a conduit, at least a portion 13 of which may be elastically deformable. The vial filler 14 may include at least one dispenser 16. It should be appreciated that one supply line 12 may be provided for and associated with each dispenser 16. The dispensers 16 may be configured, for example, as filling needles, nozzles, or the like. Optionally, the dispensers 16 may be provided with mechanical, electrical, or electro-mechanical out-of-position sensors 17.

The vial filler 14 may further comprise at least one valve 18. A valve 18 may be provided for and associated with each supply line 12 and dispenser 16. Accordingly, there may be a one-to-one-to-one correspondence between the number of supply lines 12, dispensers 16, and valves 18. A portion 20 of the supply line 12 between the valve 18 and the dispenser 16 may be rigid, semi-rigid, or flexible.

A conveyor system 22 may be provided to transport vials 24 through the apparatus 10, for example, past the vial filler 14. The conveyor system 22 may be configured to transport containers of differing sizes and geometries. For example, the conveyor system 22 may be adjusted to accommodate vials 24 having varying diameters and heights.

The vial filler 14 may further include a structure 26 with which the dispensers 16 and valves 18 are associated. The structure 26 may be configured to follow the motion of the vials 24 as they progress along a conveyor system 22 through the vial filler 14 during the filling process. The conveyor system 22 may be configured such that the vials 24 are carried to the side of a motion transmission element, for example, an endless belt, rather than above the transmission element. As a result, the conveyor system 22 may be less susceptible to contamination than a transport system that carries vials above the motion transmission element.

The dispensers 16 and valves 18 may be associated with the structure 26 such that there is substantially no relative motion between the dispensers 16 and valves 18 as the structure 26 moves. In the case of needle-type filling dispensers, the structure 26 may be a needle bridge.

The apparatus may also include a generally horizontal table 28. A space below the table 28 may comprise a non-sterile or non-aseptic zone 30. The non-aseptic zone 30 may be sealed from a space above the table, which may be an clean and sterile zone, for example, an aseptic zone 31. As such, various mechanical and electrical equipment may be disposed below the table 28 without contaminating the space above the table 28. For example, a drive 32 operatively connected to the vial filler 14 may be disposed in the non-aseptic zone below the table 28.

The drive 32 may be operatively connected to the vial filler 14 via a mechanism 34 that passes from the non-aseptic zone 30 to the aseptic zone 31 via a sealed opening 36, for example, a bellows-type seal as shown in FIG. 1. The mechanism 34 may carry the structure 26, including a housing 38. Referring to FIG. 2, the housing 38 may contain valve actuators 40. Thus, the valve actuators 40 may be movable with the structure 26, including the dispensers 16 and the valves 18. The housing 38 may provide a seal between a surrounding aseptic zone 31 and an interior, non-sterile or non-aseptic zone 33. The mechanism 34 may also be hollow to provide a non-sterile or non-aseptic zone 35, including an enclosed path 42 communicating with the lower non-aseptic zone 30 for utilities that support the actuation of the valves 18. The valve actuators 40 may be separated from the valves 18 by a flexible diaphragm 44, which again provides a seal between aseptic and non-aseptic zones 31, 33.

Additionally, a temperature sensor 46 may be positioned at or proximate to the dispenser 16. The temperature sensor 46 may be movable with the dispenser 16. Thus, the temperature of the liquid product may be measured proximate the dispenser 16 rather than in a more distally-located product supply manifold 11. As a result, filling errors associated with temperature-sensitive fluid flow properties of a product may be reduced.

The apparatus 10 may optionally comprise an enclosure 50. The enclosure 50 may cooperate with the table 28 to define an enclosed clean and sterile zone, such as aseptic zone 52, above the table 28. In such cases, suitable apparatuses (not shown) for transferring the vials into and out of the enclosed aseptic zone 52 may be provided. The enclosed aseptic zone 52 may comprise the entire aseptic zone 31 above the table 28. Alternatively, the enclosed aseptic zone 52 may comprise just a portion of the aseptic zone 31 above the table, for example, in a clean room environment.

Optionally, the filling apparatus 10 may comprise one or more additional devices. For example, the filling apparatus 10 may comprise one or more weighing devices (not shown). The weighing devices may include, for example, contact scales and non-contact weighing systems. The filling apparatus 10 may include, for example, a pre-fill weighing device and/or a post-fill weighing device. The filling apparatus 10 may comprise a capping device (not shown) and/or a sealing device (not shown) configured to close and/or seal containers filled with a product.

In operation, a liquid product may be fed from a product supply manifold 11 located in the aseptic zone 31 through one or more supply lines 12 to corresponding dispensers 16. The valves 18 may control the quantity of liquid dispensed from the dispensers 16.

In order to dispense a desired quantity, the valves 18 may be opened for a certain period of time dependent upon, for example, the pressure and temperature of the liquid product proximate the dispensers 16. As shown in FIG. 2, the valves 18 may be configured as pinch valves that pinch an elastically-deformable portion 13 of the supply lines 12 to stop the flow of liquid and lessen the pinching force to start the flow. When the valves 18 open, the liquid product may be dispensed from the dispensers 16 into a corresponding plurality of vials.

The conveyor system 22 transports vials 24 past the vial filler 14. The structure 26 may follow the motion of the vials 24 as they progress along the conveyor system 22 past the vial filler 14. Because the portion 13 of the supply lines 12 is flexible, the dispensers 16 may move to engage the vials 24, such as by a combined translational and reciprocal (i.e., horizontal and vertical) movement, while the product supply manifold 11 remains stationary. Since the valves 18 and dispensers 16 may move with the structure 26, the internal configuration or flow geometry of the portion 20 of the supply lines 12 between the dispensers 16 and the valves 18 remains substantially unchanged during movement of the structure 26 during the filling process. As a result, the accuracy of the filling apparatus may not be compromised.

It will be apparent to those skilled in the art that various modifications and variations can be made to the filling apparatus without departing from the scope or spirit of the invention. Other embodiments of the invention will be apparent to those skilled in the art from consideration of the specification and practice of the invention disclosed herein. It is intended that the specification and examples be considered as exemplary only.

What is claimed is:

1. Apparatus for aseptically filling vials with fluid from a fluid supply, the apparatus comprising:

a conveyor for transporting the vials in an aseptic zone;

a vial filling mechanism disposed in the aseptic zone, the filling mechanism including a filling needle fluidly connected to the fluid supply;

a drive mechanism operatively connected to the filling mechanism for moving the filling needle horizontally and vertically into and out of filling engagement with the vials being transported, the drive being disposed in a non-aseptic zone;

wherein the filling mechanism further includes a valve for controlling the fluid flow through said filling needle; and wherein said valve is movable with said filling needle.

2. The apparatus of claim 1, wherein the filling needle is fluidly connected to the fluid supply by a conduit;

wherein the filling mechanism further includes a fluid temperature sensor disposed in the aseptic zone proximate said filling needle;

wherein the fluid temperature sensor is operatively connected to sense fluid temperature in said conduit; and wherein the fluid temperature sensor is movable with said filling needle.

3. The apparatus of claim 1, wherein the filling needle is fluidly connected to the fluid supply by a conduit at least a portion of which is elastically deformable; and wherein said valve is a pinch valve positioned to engage said elastically deformable conduit portion.

4. The apparatus of claim 1, wherein the filling needle is fluidly connected to the fluid supply by a conduit having an interior passage with a cross-sectional shape;

wherein the valve is operatively connected to said conduit; and wherein the cross-sectional shape of the part of the conduit interior passage disposed between the filling needle and the valve remains substantially unchanged during movement of the filling needle.

5. The apparatus as in claim 1 wherein the filling needle is fluidly connected to the fluid supply by a flexible conduit;

wherein the flexible conduit includes an interior volume portion extending between the filling needle and the valve; and wherein the volume portion remains substantially the same during movement of the filling needle.

6. The apparatus of claim 1, wherein the apparatus further includes an actuator for the valve, the valve actuator being movable with said filling mechanism.

7. The apparatus of claim 1, wherein the filling mechanism is disposed above a generally horizontal table;

wherein a space below said table comprises said non-aseptic zone; and wherein the filling needle is operatively connected to said drive by a support member extending generally vertically through a sealed opening in said table.

8. The apparatus as in claim 7 wherein the support member extends through a bellows-type seal operatively connected to seal the opening in the table.

9. The apparatus of claim 7 further including an enclosure cooperating with said table to define said aseptic zone.

10. The apparatus as in claim 1 wherein the valve is disposed proximate said filling needle.

11. Apparatus for aseptically filling vials with fluid from a fluid supply, the apparatus comprising:

a substantially horizontal member defining in part adjacent aseptic and non-aseptic zones;

means for transporting the vials in the aseptic zone;

means disposed in the aseptic zone for filling the vials being transported, the vial filling means including means for engaging the vials fluidly connected to the fluid supply;

drive means operatively connected to the vial engagement means for moving the vial engagement means horizontally and vertically into and out of filling engagement with the vials being transported, the drive means being disposed in a non-aseptic zone and being connected to the vial engagement means through said horizontal member;

wherein the vial filling means further includes means for controlling the fluid flow through said vial engagement means; and wherein the controlling means is movable with said engagement means.

12. The apparatus of claim 11, wherein the engagement means is fluidly connected to the fluid supply by conduit means;

wherein the filling means further includes means for sensing temperature of the fluid in the conduit means; and wherein said temperature sensing means is disposed in the aseptic zone proximate said engagement means and is movable with said engagement means.

13. The apparatus of claim 11, wherein the engagement means is fluidly connected to the fluid supply by conduit means including an elastically deformable conduit member;

wherein said controlling means includes means for pinching together opposed walls of the conduit member.

14. The apparatus of claim 11, wherein the engagement means is fluidly connected to the fluid supply by conduit means having an interior passage with a cross-sectional shape;

wherein the controlling means is operatively connected to control fluid flow through said conduit means; and wherein the cross-sectional shape of a part of the conduit means interior passage disposed between the engagement means and the controlling means remains substantially unchanged during movement of the engagement means.

15. The apparatus as in claim 11 wherein the engagement means is fluidly connected to the fluid supply by conduit means having a flexible conduit member between the controlling means and the engagement means;

wherein the flexible conduit portion has an interior volume; and wherein the interior volume remains substantially unchanged during movement of the filling needle.

16. The apparatus of claim 11, wherein the apparatus further includes means for actuating the controlling means, the actuating means being movable with said engagement means.

17. The apparatus of claim 11, wherein the filling means is disposed above a generally horizontal table;

wherein a space below said table comprises said non-aseptic zone; and wherein the apparatus further includes movable support means operatively connected to said drive means for supporting the engagement means in the aseptic zone;

wherein the support means extends generally vertically through an opening in said table.

18. The apparatus as in claim 17 further including means for sealing the table opening while allowing movement of said support means.

19. The apparatus of claim 17 further including means for enclosing a space above the table and cooperating with said table to define said aseptic zone.

20. The apparatus as in claim 11 wherein the controlling means is disposed proximate to the engagement means.

21. Apparatus for filling pharmaceutical containers in a substantially clean and sterile environment, the apparatus comprising:

a substantially horizontal table dividing the apparatus into a substantially contamination free sterile zone and a non-sterile zone, said zones at least partially disposed in side-by-side relation;

an enclosure cooperating with said substantially horizontal table to define said sterile zone;

a transport at least partially disposed within said sterile zone that moves containers through the sterile zone;

a filling apparatus that fills the containers with pharmaceuticals in said sterile zone as the containers are moved through said sterile zone, said filling apparatus comprising at least one dispenser disposed within said sterile zone and comprising a portion disposed in said non-sterile zone, said filling apparatus extending through a sealed opening in said substantially horizontal table generally between said filling apparatus dispenser in said sterile zone and said filling apparatus portion in said non-sterile zone; and a device configured and positioned to control the flow of pharmaceuticals from said dispenser, wherein said dispenser is movable horizontally and vertically into and out of filling engagement with said containers, and wherein said device is positioned proximate to said dispenser and is movable with said dispenser.

22. The apparatus as in claim 21, wherein the dispenser is movable, the filling apparatus includes a drive positioned in the nonsterile zone and a support member interconnecting the drive and the dispenser, and the support member extends through the sealed opening.

23. Apparatus for aseptically filling containers with fluid from a fluid supply, the apparatus comprising:

a substantially horizontal table defining at least in part an upper aseptic zone and a lower non-aseptic zone;

a fluid dispenser supported by said table, the fluid dispenser being movable horizontally and vertically into and out of filling engagement with the container and operatively connected to the fluid supply; and a valve operatively connected to control fluid flow through the dispenser, the valve being movable in unison with the dispenser.

24. Apparatus for aseptically filling containers with fluid from a fluid supply, the apparatus comprising:

a vertically extending enclosure defining at least in part an aseptic zone surrounding at least one horizontally movable container;

a fluid dispenser disposed within said enclosure and operatively connected to the fluid supply;

a valve operatively connected to control fluid flow through the dispenser; and a member supporting the dispenser and the valve within the enclosure, the dispenser and the valve being movable in unison horizontally and vertically into and out of engagement with the container.

25. Apparatus for aseptically filling containers with fluid from a fluid supply, the apparatus comprising:

a linear conveyor at least partially disposed in an enclosed aseptic zone.

a fluid dispenser disposed proximate the conveyor in the aseptic zone, the dispenser being movable horizontally and vertically into and out of engagement with one or more containers being conveyed by the conveyor;

a metering device for controlling fluid flow through the dispenser; and a drive disposed in a non-aseptic zone located adjacent the enclosed aseptic zone, wherein the drive is operatively connected to move the dispenser and the metering device in unison.

26. Apparatus for aseptically filling containers with a flowable substance from a supply, the apparatus comprising:

means for providing at least a partially enclosed aseptic zone;

means operatively connected to the substance supply and disposed for metering and dispensing substance in the aseptic zone;

means for at least one of horizontally and vertically conveying containers linearly past the metering and dispensing means; and means for at least one of horizontally and vertically reciprocating the metering and dispensing means into and out of operative engagement with the containers being conveyed by said conveyor means.

27. Apparatus for aseptically filling a moving container with a flowable substance from a substance supply, the apparatus comprising:

an at least partially enclosed aseptic zone, the moving container being disposed in said zone;

a dispenser disposed in said zone and operatively connected to receive substance from the substance supply;

a substantially horizontal wall member adjacent said zone and having a sealed aperture;

a drive operatively connected to the dispenser through the sealed aperture to reciprocate the dispenser vertically into filling engagement and disengagement with the moving container; and a metering device for controlling the substance flow through the dispenser, said metering device being movable in unison with the dispensers by said drive.

28. Apparatus for filling containers in an aseptic zone from a fluid supply, the apparatus comprising:

a fluid dispenser disposed and configured to be movable within the aseptic zone, the dispenser being fluidly connected to the fluid supply;

a pinch valve for controlling fluid flow through the dispenser, the pinch valve being disposed and configured to be movable within the aseptic zone;

wherein the fluid dispenser and the pinch valve are connected for interdependent movement; and a drive operatively connected for moving the fluid dispenser horizontally and vertically into and out of filling engagement with a container disposed in the aseptic zone.

29. Method of aseptically filling containers from a fluid supply, the method comprising:

providing adjacent aseptic and non-aseptic zones;

disposing in the aseptic zone (i) a fluid dispenser in fluid communication with the fluid supply and (ii) a metering device for controlling fluid flow through the fluid dispenser;

conveying the containers through the aseptic zone to the non-aseptic zone; and reciprocating the fluid dispenser horizontally and vertically into and out of filling engagement with the moving containers in the aseptic zone; and moving the metering device substantially in unison with the fluid dispenser.

30. Method of aseptically filling containers from a fluid supply, the method comprising:

arranging a substantially horizontal table for defining, at least in part, an upper aseptic zone and a lower non-aseptic zone;

fluidly connecting the fluid supply to at lest one movable fluid dispenser supported in the aseptic zone by at least one member extending through the table from the non-aseptic zone;

transporting the containers linearly through the aseptic zone;

moving the fluid dispenser into and out of filling engagement with the container in the aseptic zone using said member; and controlling fluid flow through the fluid connection between the fluid supply and the fluid dispensers using a metering device disposed in the aseptic zone adjacent to and movable in unison with the fluid dispenser using said member.

* * * * *